US009711094B2

(12) United States Patent
Lee et al.

(10) Patent No.: US 9,711,094 B2
(45) Date of Patent: Jul. 18, 2017

(54) METHOD OF DRIVING DISPLAY PANEL AND DISPLAY APPARATUS FOR PERFORMING THE SAME

(71) Applicant: Samsung Display Co., Ltd., Yongin, Gyeonggi-do (KR)

(72) Inventors: Kyoung-Won Lee, Seoul (KR); Su-Hyeong Park, Gyeongju-si (KR); Ho-Yong Jung, Seongnam-si (KR); Sang-Mi Kim, Yongin-si (KR); Ji-Myoung Seo, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 2 days.

(21) Appl. No.: 14/462,504

(22) Filed: Aug. 18, 2014

(65) Prior Publication Data

US 2015/0145900 A1 May 28, 2015

(30) Foreign Application Priority Data

Nov. 22, 2013 (KR) ..... 10-2013-0142906

(51) Int. Cl.
*G09G 3/36* (2006.01)

(52) U.S. Cl.
CPC ..... *G09G 3/36* (2013.01); *G09G 3/3648* (2013.01); *G09G 3/3614* (2013.01); *G09G 2320/0223* (2013.01); *G09G 2320/0247* (2013.01); *G09G 2320/0257* (2013.01); *G09G 2320/103* (2013.01); *G09G 2330/021* (2013.01); *G09G 2340/0435* (2013.01)

(58) Field of Classification Search
CPC ..... G09G 3/3648; G09G 3/36; G09G 3/3614; G09G 2320/0223; G09G 2320/0247; G09G 2320/0257; G09G 2330/021; G09G 2340/0435; G09G 2320/103
USPC ..... 345/89, 691
See application file for complete search history.

(56) References Cited

U.S. PATENT DOCUMENTS 7,079,097 B2 7/2006 Lee
8,044,910 B2 10/2011 Song et al.
(Continued)

FOREIGN PATENT DOCUMENTS

KR 10-2008-0048655 A 6/2008
KR 10-2014-0076252 A 6/2014
WO WO 2013/027705 A1 2/2013

OTHER PUBLICATIONS

Machine translation (provided by Google Translate) of Saitoh et al., Publication No. WO 2013/027705 A1, previously cited on Jan. 9, 2015.

*Primary Examiner* — Dmitriy Bolotin
(74) *Attorney, Agent, or Firm* — Lewis Roca Rothgerber Christie LLP

(57) ABSTRACT

A method of driving a display panel includes generating a first driving period having a first driving frequency, generating a second driving period having a second driving frequency, and inserting a compensating frame between the first driving period and the second driving period. A display apparatus includes a display panel configured to display an image, and a display panel driver configured to generate a first driving period having a first driving frequency, to generate a second driving period having a second driving frequency, and to insert a compensating frame between the first driving period and the second driving period.

15 Claims, 11 Drawing Sheets

(56) References Cited

U.S. PATENT DOCUMENTS

| | | | | |
|---|---|---|---|---|
| 8,289,268 | B2 | 10/2012 | Park | |
| 2008/0106542 | A1* | 5/2008 | Park | G09G 5/008 345/212 |
| 2008/0297457 | A1 | 12/2008 | Song et al. | |
| 2009/0096769 | A1 | 4/2009 | Kim et al. | |
| 2009/0135128 | A1* | 5/2009 | Jeon | G09G 3/342 345/102 |
| 2009/0160845 | A1 | 6/2009 | Jang et al. | |
| 2011/0175895 | A1* | 7/2011 | Hayakawa | G09G 3/3655 345/212 |
| 2012/0113080 | A1 | 5/2012 | den Boer | |
| 2013/0278569 | A1 | 10/2013 | Choi | |
| 2015/0172622 | A1* | 6/2015 | Yoon | G09G 3/3406 345/694 |

* cited by examiner

METHOD OF DRIVING DISPLAY PANEL AND DISPLAY APPARATUS FOR PERFORMING THE SAME

CROSS-REFERENCE TO RELATED APPLICATION

This application claims priority to and the benefit of Korean Patent Application No. 10-2013-0142906, filed on Nov. 22, 2013 in the Korean Intellectual Property Office, the entire content of which is herein incorporated by reference.

BACKGROUND

1. Field

Aspects of embodiments of the present invention relate to a method of driving a display panel and a display apparatus for performing the method.

2. Description of the Related Art

Generally, a liquid crystal display ("LCD") apparatus includes a first substrate including a pixel electrode, a second substrate including a common electrode, and a liquid crystal layer disposed between the first and second substrate. An electric field is generated by voltages applied to the pixel electrode and the common electrode. By adjusting the intensity of the electric field, transmittance of light passing through the liquid crystal layer may be adjusted so that a desired image may be displayed.

To decrease power consumption of the display panel, the driving frequency of the LCD apparatus may be adjusted. When the driving frequency is changed from a relatively low frequency to a relatively high frequency, or from a relatively high frequency to a relatively low frequency, flicker may be generated so that the display quality of the display panel may deteriorate.

SUMMARY

Embodiments of the present invention provide for a method of driving a display panel capable of improving display quality by reducing or preventing flicker. Further embodiments of the present invention provide for a display apparatus for performing the method.

According to an embodiment of the present invention, a method of driving a display panel is provided. The method includes generating a first driving period having a first driving frequency, generating a second driving period having a second driving frequency, and inserting a compensating frame between the first driving period and the second driving period.

The compensating frame may include a single compensating frame.

The first driving frequency may be greater than the second driving frequency.

A length of the compensating frame may be longer than a length of a frame corresponding to the first driving frequency.

A length of the compensating frame may be shorter than a length of a frame corresponding to the second driving frequency.

A common voltage may be provided to the display panel. The common voltage received at a pixel may be defined as a practical common voltage. When the practical common voltage increases and decreases between a maximum voltage and a minimum voltage due to inversion driving of the display panel, the length of the compensating frame may be determined as a time when a waveform of the practical common voltage reaches the maximum voltage or the minimum voltage.

The first driving frequency may be less than the second driving frequency.

A length of the compensating frame may be longer than a length of a frame corresponding to the second driving frequency.

A length of the compensating frame may be shorter than a length of a frame corresponding to the first driving frequency.

A common voltage may be provided to the display panel. The common voltage received at a pixel may be defined as a practical common voltage. The length of the compensating frame may be determined as a time when a waveform of the practical common voltage reaches a level of the common voltage.

The first driving period and the second driving period may be determined based on input image data.

When the input image data represent a moving image, the display panel may be driven at the first driving frequency. When input image data represent a still image, the display panel may be driven at the second driving frequency.

The inserting of the compensating frame may include calculating a compensating driving frequency corresponding to the compensating frame, and converting a vertical synchronizing signal based on the compensating driving frequency.

According to another embodiment of the present invention, a display apparatus is provided. The display apparatus includes a display panel configured to display an image, and a display panel driver configured to generate a first driving period having a first driving frequency, to generate a second driving period having a second driving frequency, and to insert a compensating frame between the first driving period and the second driving period.

The compensating frame may include a single compensating frame.

The first driving frequency may be greater than the second driving frequency.

A length of the compensating frame may be shorter than a length of a frame corresponding to the second driving frequency.

The first driving frequency may be less than the second driving frequency.

A length of the compensating frame may be shorter than a length of a frame corresponding to the first driving frequency.

In the above method of driving the display panel, the display apparatus for performing the method, and other embodiments of the present invention, when the driving frequency is changed from a relatively high frequency to a relatively low frequency, or from a relatively low frequency to a relatively high frequency, flicker is reduced or prevented so that the display quality of the display panel may be improved.

BRIEF DESCRIPTION OF THE DRAWINGS

The above and other features and aspects of the present invention will become more apparent by describing embodiments thereof with reference to the accompanying drawings, in which.

DETAILED DESCRIPTION

Hereinafter, embodiments of the present invention will be described in detail with reference to the accompanying drawings. Herein, the use of the term "may," when describing embodiments of the present invention, refers to "one or more embodiments of the present invention." In addition, the use of alternative language, such as "or," when describing embodiments of the present invention, refers to "one or more embodiments of the present invention" for each corresponding item listed.

Figure 1:
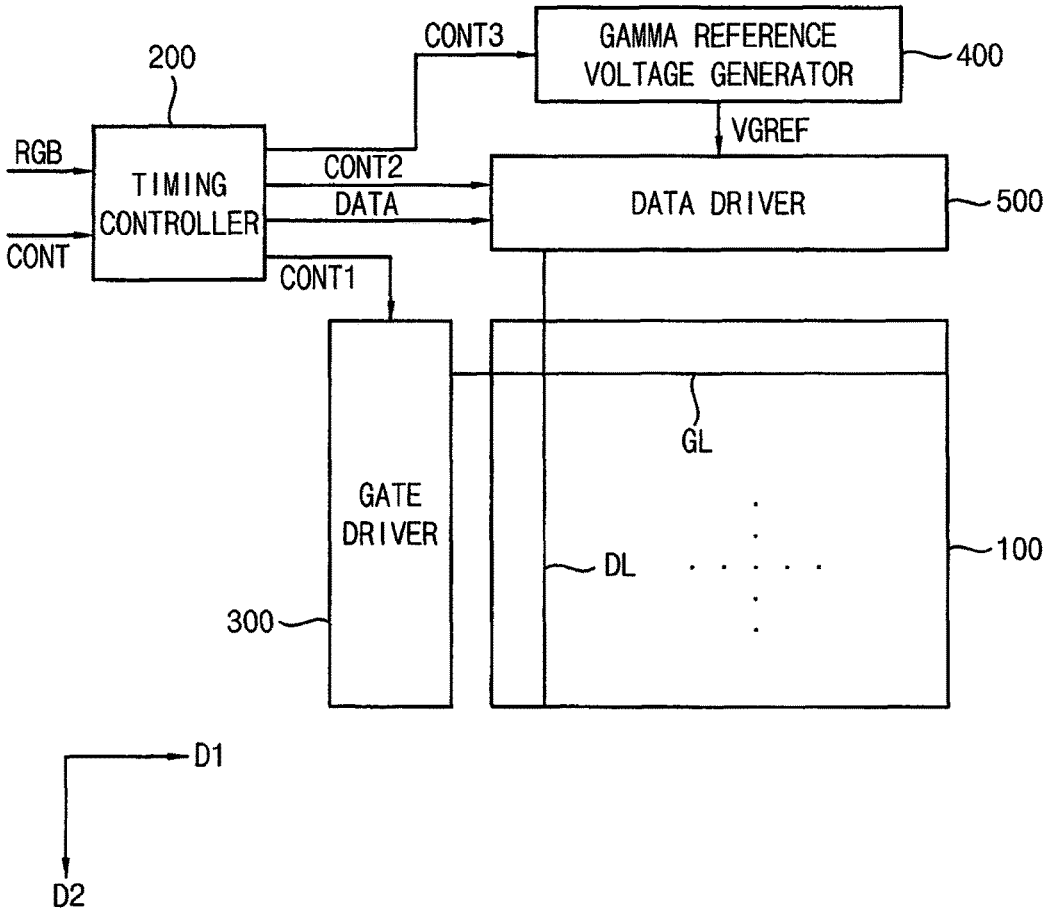
FIG. 1 is a block diagram illustrating a display apparatus according to an embodiment of the present invention.

FIG. 1 is a block diagram illustrating a display apparatus according to an embodiment of the present invention.

Referring to FIG. 1, the display apparatus includes a display panel 100 and a display panel driver. The display panel driver includes a timing controller 200, a gate driver 300, a gamma reference voltage generator 400, and a data driver 500.

The display panel 100 has a display region on which an image is displayed and a peripheral region adjacent to the display region. The display panel 100 includes a plurality of gate lines GL, a plurality of data lines DL, and a plurality of pixels connected to the gate lines GL and the data lines DL. The gate lines GL extend in a first direction D1 and the data lines DL extend in a second direction D2 crossing the first direction D1.

Each pixel includes a switching element, a liquid crystal capacitor, and a storage capacitor. The liquid crystal capacitor and the storage capacitor are electrically connected to the switching element. The unit pixels may be disposed in a matrix form.

The timing controller 200 receives input image data RGB and an input control signal CONT from an external apparatus. The input image data may include red image data R, green image data G, and blue image data B. The input control signal CONT may include a master clock signal and a data enable signal. The input control signal CONT may include a vertical synchronizing signal and a horizontal synchronizing signal.

The timing controller 200 generates a first control signal CONT1, a second control signal CONT2, a third control signal CONT3, and a data signal DATA based on the input image data RGB and the input control signal CONT. The timing controller 200 may adjust a driving frequency of the display panel 100 based on the input image data RGB. The timing controller 200 may insert an intermediate frequency compensating frame when the driving frequency of the display panel 100 is changed from a relatively high frequency to a relatively low frequency.

For example, when the input image data RGB represents a still image, the timing controller 200 adjusts the driving frequency of the display panel 100 to a relatively low frequency. When the input image data RGB represents a moving image, the timing controller 200 adjusts the driving frequency of the display panel 100 to a relatively high frequency. Thus, power consumption of the display apparatus may decrease.

The timing controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data RGB. The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

A structure of the timing controller 200 is described below referring to FIG. 4.

The gate driver 300 generates gate signals driving the gate lines GL in response to the first control signal CONT1 received from the timing controller 200. The gate driver 300 sequentially outputs the gate signals to the gate lines GL.

The gate driver 300 may be directly mounted on the display panel 100, or may be connected to the display panel 100 as a tape carrier package ("TCP") type. In another embodiment, the gate driver 300 may be integrated on the display panel 100.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA. In an embodiment, the gamma reference voltage generator 400 may be disposed in the timing controller 200 or in the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages having an analog type using the gamma reference voltages VGREF. The data driver 500 sequentially outputs the data voltages to the data lines DL.

The data driver 500 may be directly mounted on the display panel 100, or be connected to the display panel 100 in a TCP type. In another embodiment, the data driver 500 may be integrated on the display panel 100.

Figure 2:
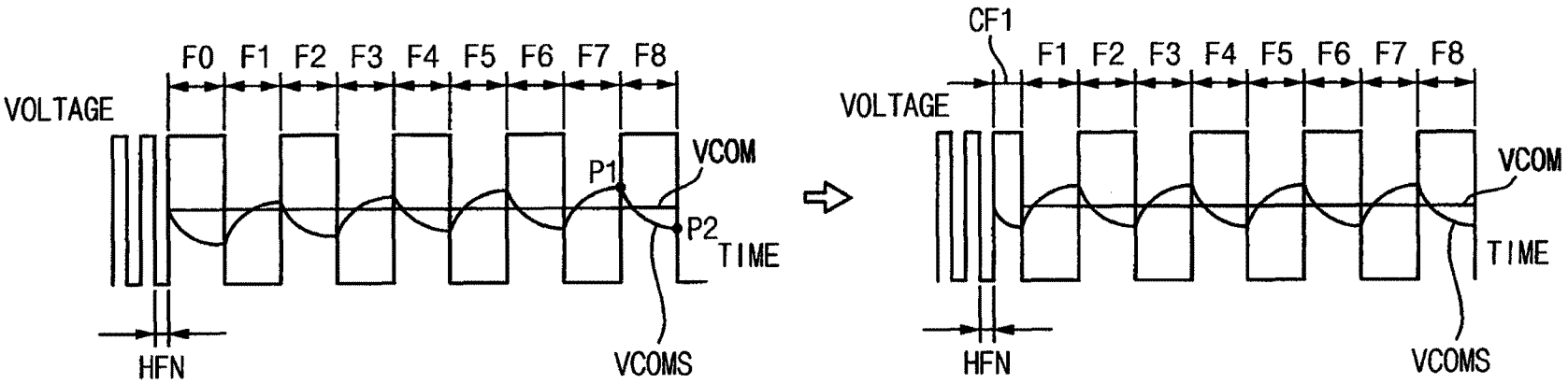
FIG. 2 is a waveform diagram illustrating a pixel voltage and a common voltage when a driving frequency of a display panel of FIG. 1 is changed from a relatively high frequency to a relatively low frequency, both with and without an intermediate frequency compensating frame.
Figure 3:
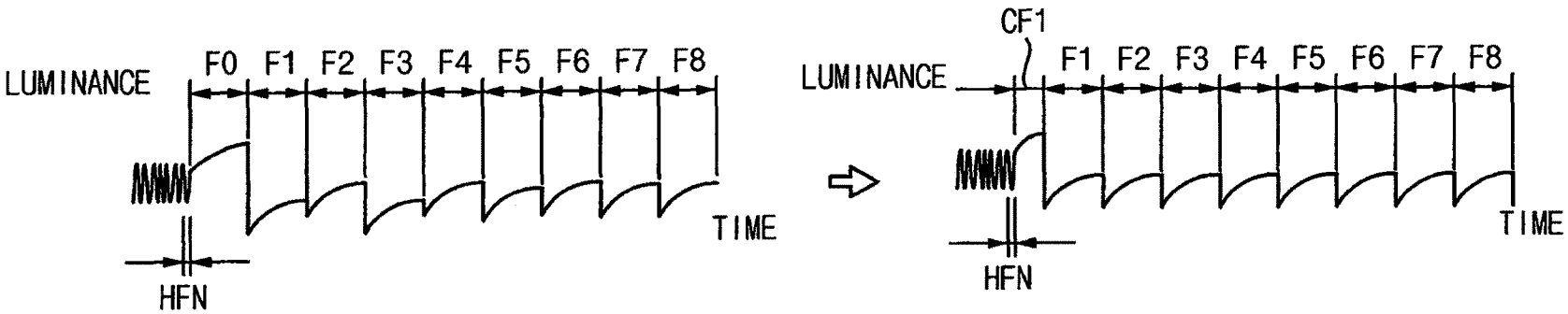
FIG. 3 is a waveform diagram illustrating a luminance of the display panel of FIG. 1 when the driving frequency of the display panel of FIG. 1 is changed from a relatively high frequency to a relatively low frequency, both with and without an intermediate frequency compensating frame.

FIG. 2 is a waveform diagram illustrating a pixel voltage and a common voltage when a driving frequency of the display panel 100 of FIG. 1 is changed from a relatively high frequency to a relatively low frequency, both with (on the right) and without (on the left) an intermediate frequency compensating frame. FIG. 3 is a waveform diagram illustrating a luminance of the display panel 100 of FIG. 1 when the driving frequency of the display panel 100 of FIG. 1 is changed from a relatively high frequency to a relatively low frequency, both with (on the right) and without (on the left) an intermediate frequency compensating frame.

Referring to FIGS. 1 to 3, the driving frequency of the display panel 100 is changed from a relatively high frequency to a relatively low frequency. The common voltage VCOM provided to the display panel 100 is a direct-current ("DC") voltage having a constant (or relatively constant) DC level. However, from a practical standpoint, the common voltage as actually measured at the pixel may not have the DC level. This may be due to effects such as inversion driving, where, for example, the data voltage flips polarity (e.g., from a positive data voltage to a negative data voltage or vice versa) with respect to the common voltage each frame). In FIG. 2, the common voltage VCOM is illustrated as a flat line while the alternating polarity of the data voltage is illustrated as a square wave that alternates between being above and below the common voltage VCOM. From a practical standpoint, the common voltage actually experienced or measured at the pixel is defined as a practical common voltage VCOMS.

When a positive data voltage is applied to the pixel, the practical common voltage VCOMS may decrease due to the residual DC of the pixel. When a negative data voltage is applied to the pixel, the practical common voltage VCOMS may increase due to the residual DC of the pixel. In a steady state, the practical common voltage VCOMS may repeatedly increase and decrease between a first peak (or maximum voltage or relative maximum voltage) P1 and a second peak (or minimum voltage or relative minimum voltage) P2, as illustrated in FIG. 2 left. In addition, once in a steady state, the maximum voltage P1 may have a value corresponding to the minimum voltage P2 with respect to the common voltage VCOM. For example, a difference between the maximum voltage P1 and the common voltage VCOM may be substantially the same as a difference between the common voltage VCOM and the minimum voltage P2.

When the driving frequency of the display panel 100 is relatively low, increase and decrease of the practical common voltage VCOMS may be more significant. In the present embodiment, as illustrated in FIG. 2, the practical common voltage VCOMS increases and decreases in the relatively low driving frequency. In the relatively high driving frequency, the effect of the residual DC at each pixel may be ignored. Thus, in the relatively high driving frequency, the practical common voltage VCOMS may be regarded as the same as the common voltage VCOM.

As illustrated in FIG. 2 left, when the driving frequency is changed from an N-th high frequency frame HFN having a relatively high frequency to an initial low frequency frame F0 having a relatively low frequency without an intermediate frequency compensating frame, the practical common voltage VCOMS increases or decreases from the level of the common voltage VCOM. When the initial low frequency frame F0 has a positive polarity, the practical common voltage VCOMS decreases from the level of the common voltage VCOM in the initial low frequency frame F0.

In a first low frequency frame F1 of the relatively low frequency, the practical common voltage VCOMS increases. In a second low frequency frame F2 of the relatively low frequency, the practical common voltage VCOMS decreases again.

During first to eighth low frequency frames F1 to F8 of the relatively low frequency, the practical common voltage VCOMS repeatedly increases and decreases with respect to the common voltage VCOM. At some point, the practical common voltage VCOMS proceeds to symmetrically increase and decrease with respect to the common voltage VCOM. For example, in the seventh and eighth low frequency frames F7 and F8 of FIG. 2 left, the practical common voltage VCOMS symmetrically increases and decreases with respect to the common voltage VCOM between a minimum voltage P2 and a maximum voltage P1. Thus, the practical common voltage VCOMS may be in a steady state from the seventh and eighth low frequency frames F7 and F8 on.

In contrast, the practical common voltage VCOMS is not symmetrical with respect to the common voltage VCOM in the initial and first low frequency frames F0 and F1. Thus, luminance in the initial low frequency frame F0 is quite different from luminance in the first low frequency frame F1 for the same image, as illustrated in FIG. 3 left. The difference of the luminance in the initial and first frames F0 and F1 may generate flicker.

However, as illustrated in FIG. 2 right, according to an embodiment of the present invention, when the driving frequency of the display panel 100 is changed from the N-th high frequency frame HFN to the first low frequency frame a first intermediate frequency compensating frame CF1 (having a frequency between that of the relatively high frequency and the relatively low frequency) is inserted between the N-th high frequency frame HFN and the first low frequency frame F1. A length of the first intermediate frequency compensating frame CF1 is shorter than a length of the first low frequency frame F1. For example, when the relatively low driving frequency is about 1 Hz, a length of the low frequency frame is about 1 second. Accordingly, the length of the first intermediate frequency compensating frame CF1 would be shorter than 1 second.

The length of the first intermediate frequency compensating frame CF1 is determined as a time when a waveform of the practical common voltage VCOMS reaches the maximum voltage P1 or the minimum voltage P2. In FIG. 2 right, a positive data voltage is applied to the pixel in the first intermediate frequency compensating frame CF1. In the first intermediate frequency compensating frame CF1, the practical common voltage VCOMS decreases from the level of the common voltage VCOM to the minimum voltage P2. When the practical common voltage VCOMS reaches the minimum voltage P2, the first intermediate frequency compensating frame CF1 ends.

Accordingly, at a start of the first low frequency frame F1 in FIG. 2 right, the practical common voltage VCOMS has a level of the minimum voltage P2, which is a minimum voltage of a steady state of the practical common voltage VCOMS. Thus, the waveform of the practical common voltage VCOMS may proceed in a steady state from the first low frequency frame F1 on. The practical common voltage VCOMS increases and decreases between the maximum voltage P1 and the minimum voltage P2 from the first low frequency frame F1 on.

The practical common voltage VCOMS is symmetrical with respect to the common voltage VCOM in the first and second low frequency frames F1 and F2. Thus, as illustrated in FIG. 3 right, luminance in the first low frequency frame F1 is substantially the same as luminance in the second low frequency frame F2 for the same image. Therefore, the effect of the residual DC on the practical common voltage VCOMS at each pixel is reduced or minimized by inserting the first intermediate frequency compensating frame CF1 so that the display panel 100 may not generate flicker.

The length of the first intermediate frequency compensating frame CF1 may be determined by measuring the practical common voltage VCOMS. In another embodiment, the length of the first intermediate frequency compensating frame CF1 may be determined not to generate flicker by visual inspection.

Figure 4:
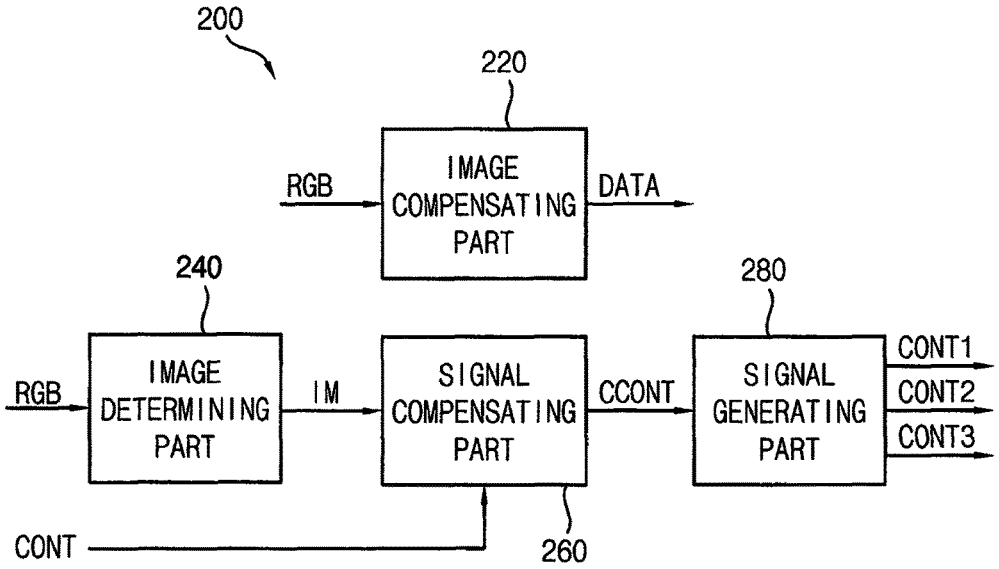
FIG. 4 is a block diagram illustrating a timing controller of FIG. 1.
Figure 5:
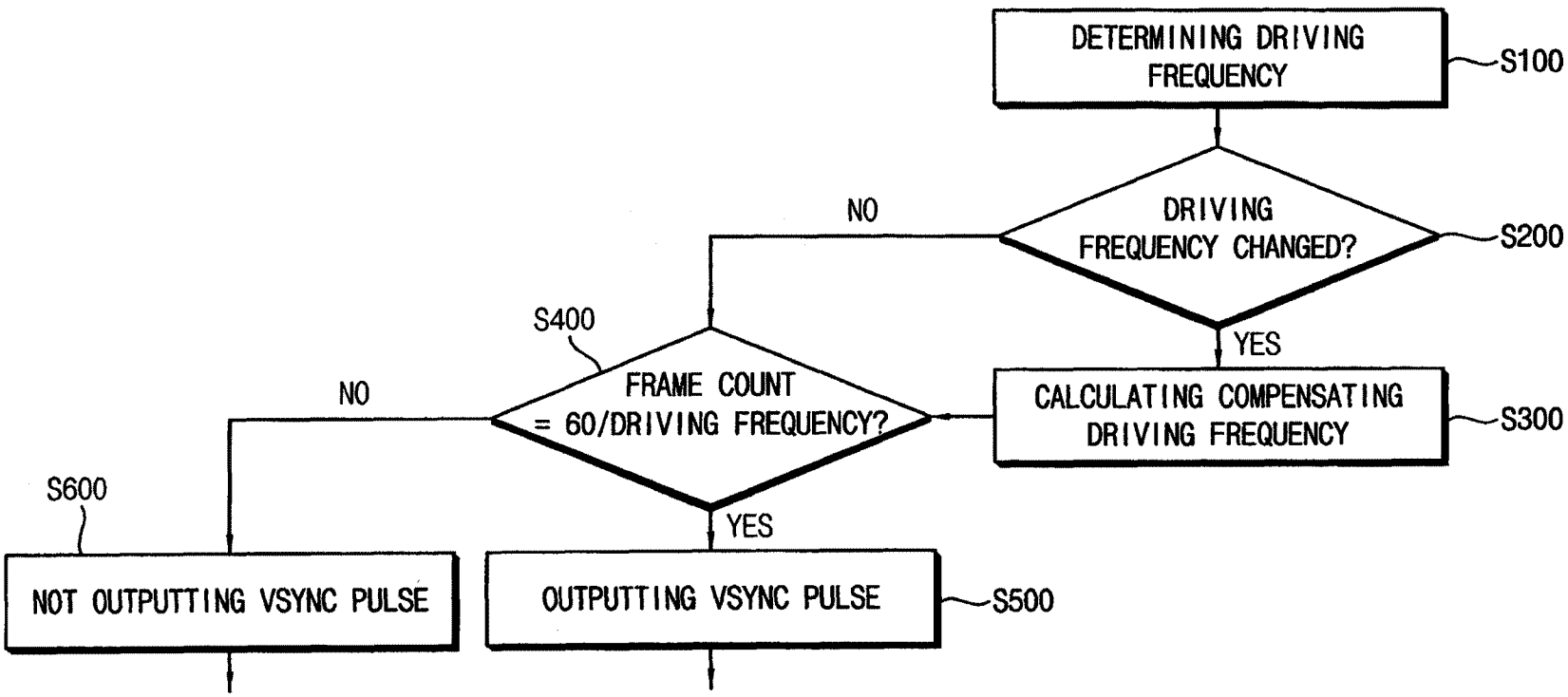
FIG. 5 is a flowchart illustrating an operation of a signal compensating part of the timing controller of FIG. 4.
Figure 6:
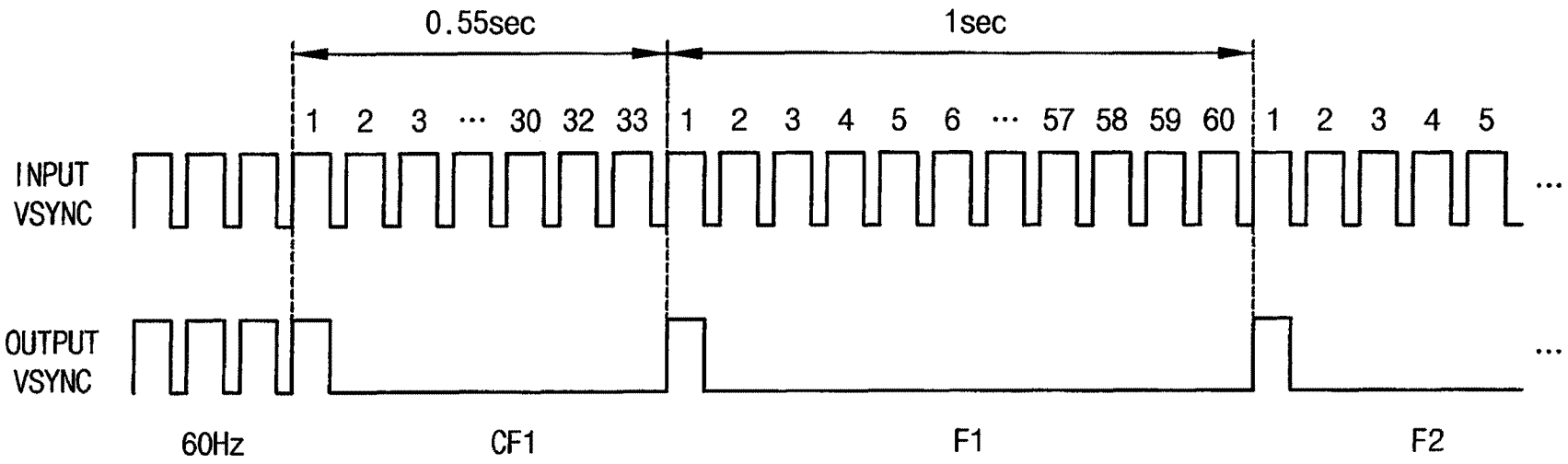
FIG. 6 is a timing diagram illustrating a method of adjusting a vertical start signal by the signal compensating part of the timing controller of FIG. 4.

FIG. 4 is a block diagram illustrating the timing controller 200 of FIG. 1. FIG. 5 is a flowchart diagram illustrating an operation of a signal compensating part 260 of FIG. 4. FIG. 6 is a timing diagram illustrating a method of adjusting a vertical start signal by the signal compensating part 260 of FIG. 4.

Referring to FIGS. 1 to 6, the timing controller 200 includes an image compensating part 220, an image determining part 240, a signal compensating part 260, and a signal generating part 280. The image compensating part 220 receives the input image data RGB. The image compensating part 220 compensates a grayscale of the input image data RGB. The image compensating part 220 may include an adaptive color correcting part and a dynamic capacitance compensating part.

The adaptive color correcting part receives the gray level data of the input image data RGB and operates an adaptive color correction ("ACC"). The adaptive color correcting part may compensate the gray level data using a gamma curve. The dynamic capacitance compensating part operates a dynamic capacitance compensation ("DCC"), which compensates the gray level data of present frame data using previous frame data and the present frame data.

The image compensating part 220 compensates the grayscale of the input image data RGB and rearranges the input image data RGB to generate the data signal DATA to correspond to a data type of the data driver 500. The data signal DATA may have a digital type. The image compensating part 220 outputs the data signal DATA to the data driver 500.

The image determining part 240 receives the input image data RGB. The image determining part 240 determines an image mode IM based on the input image data RGB.

The image determining part 240 provides data to adjust the driving frequency to the signal compensating part 260 based on the input image data RGB. For example, the image determining part 240 may determine that the input image data RGB represents a still image or a moving image and generate the image mode IM. The image mode IM may include a still image mode and a moving image mode. In another embodiment, the image determining part 240 may determine a degree of movement of the input image data RGB so that the image determining part 240 may generate various image modes 1M. The image determining part 240 outputs the image mode IM to the signal compensating part 260.

The signal compensating part 260 determines the driving frequency based on the input image data RGB. For example, the signal compensating part 260 may adjust the driving frequency based on the image mode IM received from the image determining part 240. When the image mode IM is a still image mode, the signal compensating part 260 may adjust the driving frequency to a relatively low frequency. When the image mode IM is a moving image mode, the signal compensating part 260 may adjust the driving frequency to a relatively high frequency. For example, the relatively low frequency may be about 1 Hz, and the relatively high frequency may be about 60 Hz.

When the driving frequency decreases from the relatively high frequency to the relatively low frequency, the signal compensating part 260 generates a compensating control signal CCONT to insert the first intermediate frequency compensating frame CF1. The signal compensating part 260 converts the input control signal CONT to generate the compensating control signal CCONT. The input control signal CONT may include a vertical synchronizing signal VSYNC, a horizontal synchronizing signal HSYNC, and a data enable signal DE. The signal compensating part 260 converts the vertical synchronizing signal VSYNC, the horizontal synchronizing signal HSYNC, and the data enable signal DE. The signal compensating part 260 may convert the vertical synchronizing signal VSYNC, the horizontal synchronizing signal HSYNC, and the data enable signal DE considering the length of the first intermediate frequency compensating frame CF1.

Hereinafter, an operation of the signal compensating part 260 is described in detail referring to FIG. 5.

The signal compensating part 260 determines the driving frequency based on the image mode IM (step S100). The signal compensating part 260 determines whether the driving frequency is changed (step S200). When the driving frequency is changed, the signal compensating part 260 determines an intermediate frequency compensating frame due to the change of the driving frequency, and calculates a compensating driving frequency of the intermediate frequency compensating frame (step S300).

The compensating driving frequency may be inversely proportional to the length of the intermediate frequency compensating frame. For example, when the length of the intermediate frequency compensating frame is about 0.55 seconds, the compensating driving frequency may be about 1.818 Hz. In an embodiment, the compensating driving frequency is greater than the relatively low driving frequency and less than the relatively high driving frequency.

The signal compensating part 260 counts the number of pulses of an input vertical synchronizing signal INPUT VSYNC. The number of the pulse of the input vertical synchronizing signal INPUT VSYNC is called to a frame count. The signal compensating part 260 compares the frame count and 60/driving frequency (step S400). When the frame count is equal to 60/driving frequency (or, in another embodiment, is the closest integer to 60/driving frequency), a pulse of an output vertical synchronizing signal OUTPUT VSYNC is outputted (step S500). When the frame count is not equal to 60/driving frequency, a pulse of an output vertical synchronizing signal OUTPUT VSYNC is not outputted (step S600).

FIG. 6 represents the output vertical synchronizing signal OUTPUT VSYNC when the relatively high driving frequency is about 60 Hz, the relatively low driving frequency is about 1 Hz and the length of the first intermediate frequency compensating frame CF1 is about 0.55 seconds.

The compensating driving frequency of the first intermediate frequency compensating frame CF1 is about 1.818 Hz. Thus, the output vertical synchronizing signal OUTPUT VSYNC outputs one pulse among 33 pulses, which corresponds to 60/1.818.

Referring back to FIG. 4, the signal generating part 280 receives the compensating control signal CCONT. The signal generating part 280 generates the first control signal CONT1 to control a driving timing of the gate driver 300 based on the compensating control signal CCONT. The signal generating part 280 generates the second control signal CONT2 to control a driving timing of the data driver 500 based on the compensating control signal CCONT. The signal generating part 280 generates the third control signal CONT3 to control a driving timing of the gamma reference voltage generator 400 based on the compensating control signal CCONT.

The signal generating part 280 outputs the first control signal CONT1 to the gate driver 300. The signal generating part 280 outputs the second control signal CONT2 to the data driver 500. The signal generating part 280 outputs the third control signal CONT3 to the gamma reference voltage generator 400.

According to embodiments of the present invention, when the driving frequency of the display panel 100 is changed from a relatively high frequency to a relatively low frequency, flicker is reduced or prevented so that the display quality of the display panel 100 may be improved.

Figure 7:
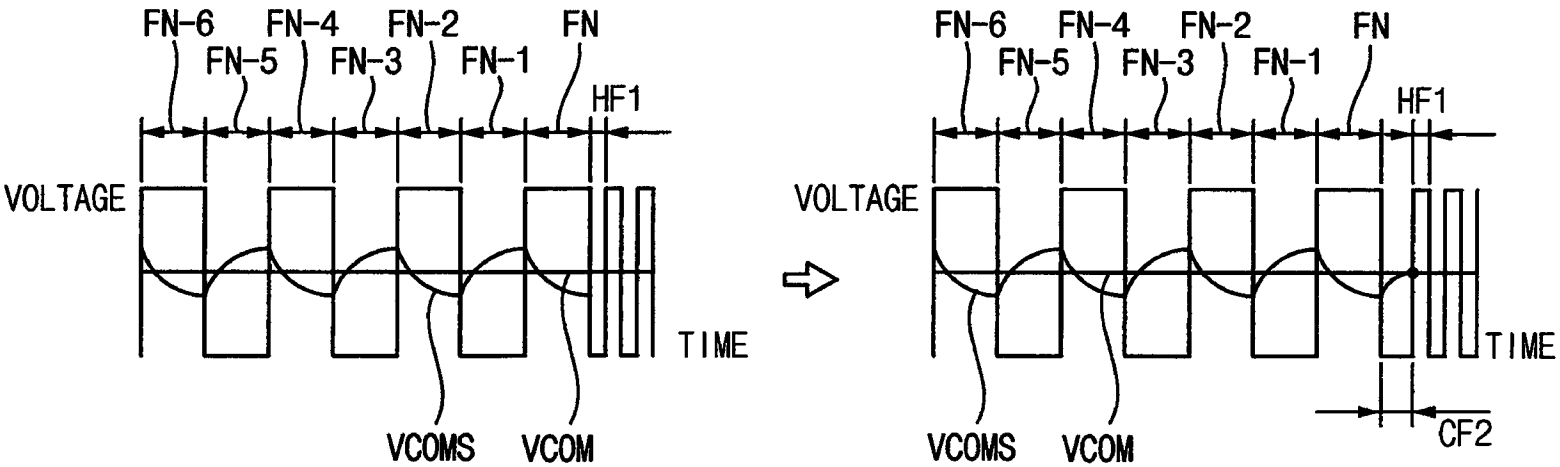
FIG. 7 is a waveform diagram illustrating a pixel voltage and a common voltage when a driving frequency of a display panel according to an embodiment of the present invention is changed from a relatively low frequency to a relatively high frequency, both with and without an intermediate frequency compensating frame.
Figure 8:
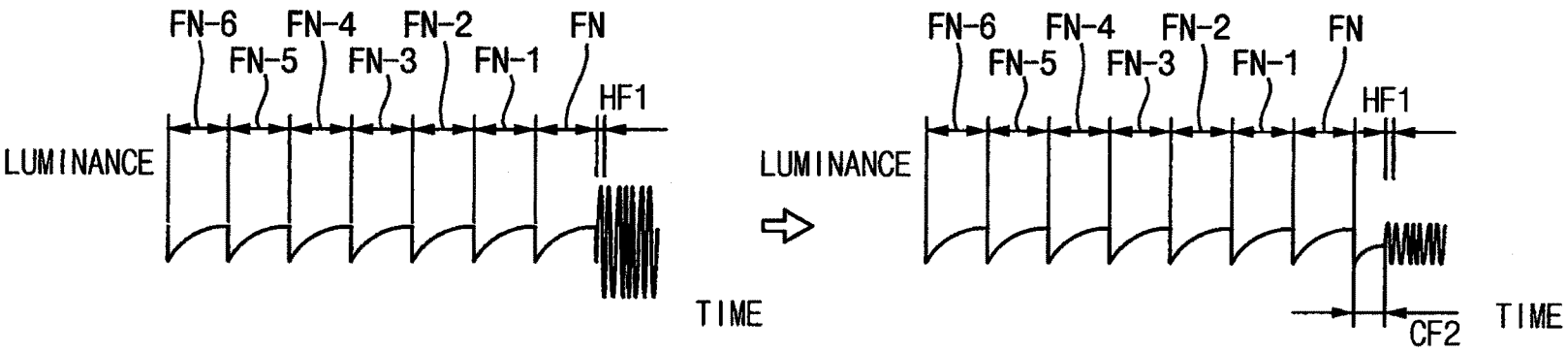
FIG. 8 is a waveform diagram illustrating a luminance of the display panel of FIG. 7 when the driving frequency of the display panel of FIG. 7 is changed from a relatively low frequency to a relatively high frequency, both with and without an intermediate frequency compensating frame.
Figure 9:
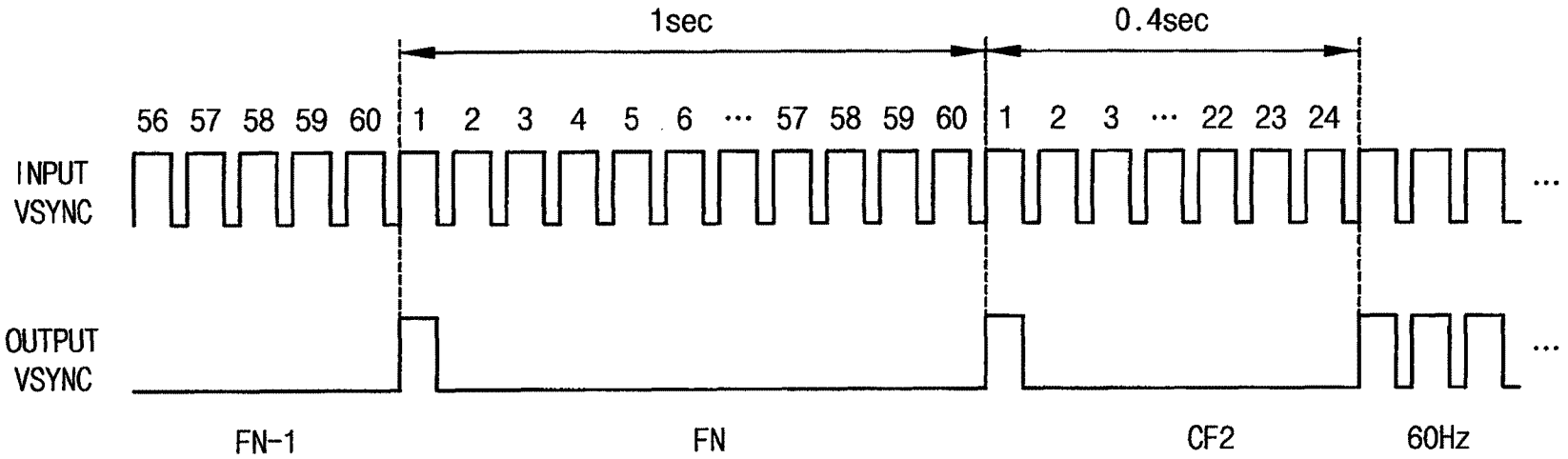
FIG. 9 is a timing diagram illustrating a method of adjusting a vertical start signal by a signal compensating part of a display apparatus including the display panel of FIG. 7.

FIG. 7 is a waveform diagram illustrating a pixel voltage and a common voltage when a driving frequency of a display panel according to an embodiment of the present invention is changed from a relatively low frequency to a relatively high frequency, both with (on the right) and without (on the left) an intermediate frequency compensating frame. FIG. 8 is a waveform diagram illustrating a luminance of the display panel of FIG. 7 when the driving frequency of the display panel of FIG. 7 is changed from a relatively low frequency to a relatively high frequency, both with (on the right) and without (on the left) an intermediate frequency compensating frame. FIG. 9 is a timing diagram illustrating a method of adjusting a vertical start signal by the signal compensating part of a display apparatus having the display panel of FIG. 7.

The display apparatus according to the embodiment of FIGS. 7 to 9 is substantially the same as the display apparatus of the embodiment described referring to FIGS. 1 to 6 except that an intermediate frequency compensating frame is inserted when the driving frequency is changed from a relatively low frequency to a relatively high frequency. Thus, the same reference numerals will be used to refer to the same or like parts as those described in the embodiment of FIGS. 1 to 6, and description concerning the above elements may not be repeated.

Referring to FIGS. 1, 4, 5, 7 to 9, the display apparatus includes a display panel 100 and a display panel driver. The display panel driver includes a timing controller 200, a gate driver 300, a gamma reference voltage generator 400, and a data driver 500.

The timing controller 200 may adjust a driving frequency of the display panel 100 based on the input image data RGB. The timing controller 200 may insert an intermediate frequency compensating frame when the driving frequency of the display panel 100 is changed from a relatively low frequency to a relatively high frequency. In the embodiment of FIGS. 7 to 9, the driving frequency of the display panel 100 is changed from a relatively low frequency to a relatively high frequency.

The common voltage VCOM provided to the display panel 100 is a direct-current ("DC") voltage having a constant (or relatively constant) DC level. However, from a practical standpoint, the common voltage as actually measured at each pixel may not have the DC level. From a practical standpoint, the common voltage actually experienced or measured at each pixel is defined as a practical common voltage VCOMS.

When a positive data voltage is applied to the pixel, the practical common voltage VCOMS may decrease due to the residual DC of the pixel. When a negative data voltage is applied to the pixel, the practical common voltage VCOMS may increase due to the residual DC of the pixel. In a steady state, the practical common voltage VCOMS may repeatedly increase and decrease between a maximum voltage P1 and a minimum voltage P2. In addition, once in a steady state, the maximum voltage P1 may have a value corresponding to the minimum voltage P2 with respect to the common voltage VCOM. For example, a difference between the maximum voltage P1 and the common voltage VCOM may be substantially the same as a difference between the common voltage VCOM and the minimum voltage P2.

As illustrated in FIG. 7 left, when the driving frequency is changed from an N-th low frequency frame FN having a relatively low frequency to a first high frequency frame HF1 having a relatively high frequency without an intermediate frequency compensating frame, the practical common voltage VCOMS is quite different from a level of the common voltage VCOM at a start of the first high frequency frame HF1.

Thus, as illustrated in FIG. 8 left, luminance of the display panel 100 significantly oscillates in the first high frequency frame HF1 (and possibly one or more succeeding high frequency frames). Therefore, the oscillation of the luminance may be perceived by a user as flicker.

However, as illustrated in FIG. 7 right, according to an embodiment of the present embodiment, when the driving frequency of the display panel 100 is changed from the N-th low frequency frame FN to the first high frequency frame HF1, a second intermediate frequency compensating frame CF2 (having a frequency between that of the relatively high frequency and the relatively low frequency) is inserted between the N-th low frequency frame FN and the first high frequency frame HF1.

A length of the second intermediate frequency compensating frame CF2 is shorter than a length of the N-th low frequency frame FN. For example, when the relatively low driving frequency is about 1 Hz, a length of the low frequency frame is about 1 second. Accordingly, the length of the second intermediate frequency compensating frame CF2 would be shorter than 1 second.

The length of the second intermediate frequency compensating frame CF2 is determined as a time when a waveform of the practical common voltage VCOMS reaches the common voltage VCOM. In FIG. 7 right, a negative data voltage is applied to the pixel in the second intermediate frequency compensating frame CF2. In the second intermediate frequency compensating frame CF2, the practical common voltage VCOMS increases from a level less than the common voltage VCOM toward the common voltage VCOM. When the practical common voltage VCOMS reaches the common voltage VCOM, the second intermediate frequency compensating frame CF2 ends.

Accordingly, at a start of the first high frequency frame HF1, the practical common voltage VCOMS has a level of the common voltage VCOM. Thus, the luminance of the first high frequency frame HF1 (and possibly one or more succeeding high frequency frames) may not significantly oscillate. Therefore, the effect of the residual DC on the practical common voltage VCOMS at each pixel is reduced or minimized by inserting the second intermediate frequency compensating frame CF2 so that the display panel 100 may not generate flicker.

The length of the second intermediate frequency compensating frame CF2 may be determined by measuring the practical common voltage VCOMS. In another embodiment, the length of the second intermediate frequency compensating frame CF2 may be determined not to generate flicker by visual inspection.

FIG. 9 represents the output vertical synchronizing signal OUTPUT VSYNC when the relatively high driving frequency is about 60 Hz, the relatively low driving frequency is about 1 Hz and the length of the second intermediate frequency compensating frame CF2 is about 0.4 seconds.

The compensating driving frequency of the second intermediate frequency compensating frame CF2 is about 2.5 Hz. Thus, the output vertical synchronizing signal OUTPUT VSYNC outputs one pulse among 24 pulses, which corresponds to 60/2.5.

According to embodiments of the present invention, when the driving frequency of the display panel 100 is changed from a relatively low frequency to a relatively high frequency, flicker is reduced or prevented so that the display quality of the display panel 100 may be improved.

Figure 10:
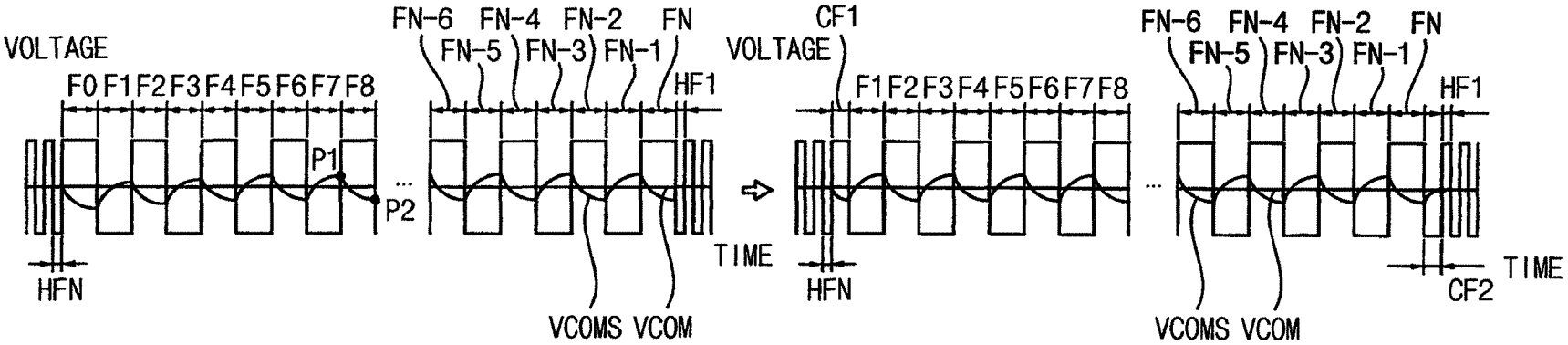
FIG. 10 is a waveform diagram illustrating a pixel voltage and a common voltage when a driving frequency of a display panel according to an embodiment of the present invention is changed from a relatively high frequency to a relatively low frequency, and from the relatively low frequency back to the relatively high frequency, both with and without an intermediate frequency compensating frame.
Figure 11:
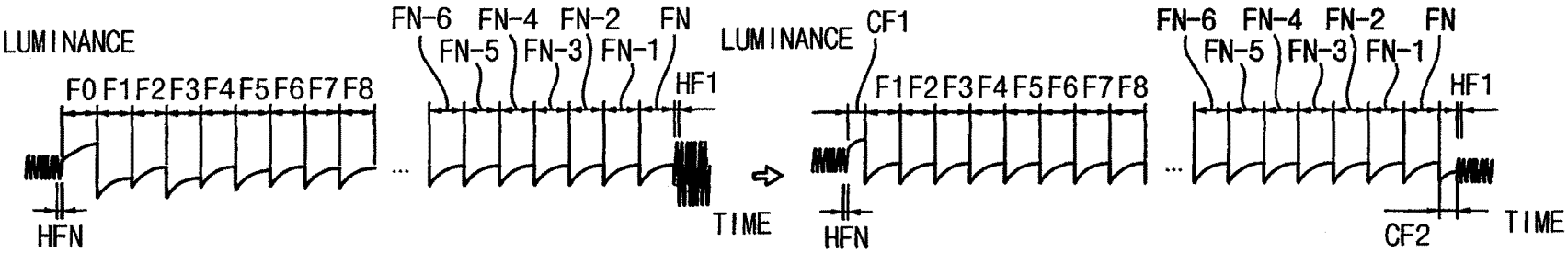
FIG. 11 is a waveform diagram illustrating a luminance of the display panel of FIG. 10 when the driving frequency of the display panel of FIG. 10 is changed from a relatively high frequency to a relatively low frequency, and from the relatively low frequency back to the relatively high frequency, both with and without an intermediate frequency compensating frame.

FIG. 10 is a waveform diagram illustrating a pixel voltage and a common voltage when a driving frequency of a display panel of a display apparatus according to an embodiment of the present invention is changed from a relatively high frequency to a relatively low frequency, and from the relatively low frequency back to the relatively high frequency, both with (on the right) and without (on the left) an intermediate frequency compensating frame. FIG. 11 is a waveform diagram illustrating a luminance of the display panel of FIG. 10 when the driving frequency of the display panel of FIG. 10 is changed from a relatively high frequency to a relatively low frequency, and from the relatively low frequency back to the relatively high frequency, both with (on the right) and without (on the left) an intermediate frequency compensating frame.

The display apparatus according to the embodiment of FIGS. 10 to 11 is substantially the same as the display apparatus of the embodiment described referring to FIGS. 1 to 6 except that intermediate frequency compensating frames are inserted when the driving frequency is changed from a relatively high frequency to a relatively low frequency, and from the relatively low frequency back to the relatively high frequency. Thus, the same reference numerals will be used to refer to the same or like parts as those described in the embodiment of FIGS. 1 to 6, and description concerning the above elements may not be repeated.

Referring to FIGS. 1, 4, 5, 10 and 11, the display apparatus includes a display panel 100 and a display panel driver. The display panel driver includes a timing controller 200, a gate driver 300, a gamma reference voltage generator 400, and a data driver 500.

The timing controller 200 may adjust a driving frequency of the display panel 100 based on the input image data RGB. The timing controller 200 may insert a first intermediate frequency compensating frame CF1 when the driving frequency of the display panel 100 is changed from a relatively high frequency to a relatively low frequency. The timing controller 200 may insert a second intermediate frequency compensating frame CF2 when the driving frequency of the display panel 100 is changed from a relatively low frequency to a relatively high frequency.

The common voltage VCOM provided to the display panel 100 is a direct-current ("DC") voltage having a constant (or relatively constant) DC level. However, from a practical standpoint, the common voltage as actually measured at each pixel may not have the DC level. From a practical standpoint, the common voltage actually experienced or measured at each pixel is defined as a practical common voltage VCOMS.

When a positive data voltage is applied to the pixel, the practical common voltage VCOMS may decrease due to the residual DC of the pixel. When a negative data voltage is applied to the pixel, the practical common voltage VCOMS may increase due to the residual DC of the pixel. In a steady state, the practical common voltage VCOMS may repeatedly increase and decrease between a maximum voltage P1 and a minimum voltage P2. In addition, once in a steady state, the maximum voltage P1 may have a value corresponding to the minimum voltage P2 with respect to the common voltage VCOM. For example, a difference between the maximum voltage P1 and the common voltage VCOM may be substantially the same as a difference between the common voltage VCOM and the minimum voltage P2.

In the embodiment of FIGS. 10 to 11, when the driving frequency of the display panel 100 is changed from the N-th high frequency frame HFN to the first low frequency frame F1, a first intermediate frequency compensating frame CF1 is inserted between the N-th high frequency frame HFN and the first low frequency frame F1.

A length of the first intermediate frequency compensating frame CF1 is shorter than a length of the first low frequency frame F1. For example, when the relatively low driving frequency is about 1 Hz, a length of the frame of the relatively low frequency is about 1 second. Accordingly, the length of the first intermediate frequency compensating frame CF1 would be shorter than 1 second.

At a start of the first low frequency frame F1, the practical common voltage VCOMS has a level of the minimum voltage P2, which is a minimum voltage of a steady state of the practical common voltage VCOMS. Thus, the waveform of the practical common voltage VCOMS may proceed in a steady state from the first low frequency frame F1 on. The practical common voltage VCOMS increases and decreases between the maximum voltage P1 and the minimum voltage P2 from the first low frequency frame F1 on.

The practical common voltage VCOMS is symmetrical with respect to the common voltage VCOM in the first and second low frequency frames F1 and F2. Thus, luminance in the first low frequency frame F1 is substantially the same as luminance in the second low frequency frame F2 for the same image. Therefore, the effect of the residual DC on the practical common voltage VCOMS at each pixel is reduced or minimized by inserting the first intermediate frequency compensating frame CF1 so that the display panel 100 may not generate flicker.

In the embodiment of FIGS. 10 to 11, when the driving frequency of the display panel 100 is changed from the N-th low frequency frame FN to the first high frequency frame HF1, a second intermediate frequency compensating frame CF2 is inserted between the N-th low frequency frame FN and the first high frequency frame HF1.

A length of the second intermediate frequency compensating frame CF2 is shorter than a length of the N-th low frequency frame FN. For example, when the relatively low driving frequency is about 1 Hz, a length of the frame of the relatively low frequency is about 1 second. Accordingly, the length of the second intermediate frequency compensating frame CF2 would be shorter than 1 second.

Accordingly, at a start of the first high frequency frame HF1, the practical common voltage VCOMS has a level of the common voltage VCOM. Thus, the luminance of the first high frequency frame HF1 may not significantly oscillate. Therefore, the effect of the residual DC on the practical common voltage VCOMS at each pixel is reduced or minimized by inserting the second intermediate frequency compensating frame CF2 so that the display panel 100 may not generate flicker.

According to embodiments of the present invention, when the driving frequency of the display panel 100 is changed from a relatively low frequency to a relatively high frequency, flicker is reduced or prevented, and when the driving frequency of the display panel 100 is changed from a relatively high frequency to a relatively low frequency, flicker is reduced or prevented so that the display quality of the display panel 100 may be improved.

According to embodiments of the present invention as described above, the driving frequency is adjusted based on the input image data so that the power consumption of the display apparatus may decrease. In addition, flicker due to change of the driving frequency is reduced or prevented so that the display quality of the display apparatus may be improved.

The foregoing is illustrative of the present invention and is not to be construed as limiting thereof. Although a few embodiments of the present invention have been described, those skilled in the art will readily appreciate that many modifications are possible in the embodiments without materially departing from the features and aspects of the present invention. Accordingly, all such modifications are intended to be included within the scope of the present invention as defined in the claims and their equivalents. In the claims, means-plus-function clauses are intended to cover the structures described herein as performing the recited function as well as structural equivalents and equivalent structures.

Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims and their equivalents.

What is claimed is:

1. A method of driving a display panel, the method comprising:

generating a first driving period for a plurality of first frames having a first driving frequency;

generating a second driving period for a plurality of second frames having a second driving frequency different than the first driving frequency, one of the first driving frequency and the second driving frequency being a relatively high frequency for displaying a moving image and another of the first driving frequency and the second driving frequency being a relatively low frequency for displaying a still image; and inserting only one compensating frame between the first driving period and the second driving period, the one compensating frame having an intermediate frequency between the relatively high frequency for displaying the moving image and the relatively low frequency for displaying the still image, wherein a length of the one compensating frame corresponds to a time for changing a level of a common voltage of a pixel.

2. The method of claim 1, wherein the first driving frequency is greater than the second driving frequency.

3. The method of claim 1, wherein the first driving frequency is less than the second driving frequency.

4. The method of claim 1, wherein the first driving period and the second driving period are determined based on input image data.

5. The method of claim 4, wherein when the input image data represent the moving image, the display panel is driven at the first driving frequency, and when the input image data represent the still image, the display panel is driven at the second driving frequency.

6. The method of claim 1, wherein the inserting of the compensating frame comprises:

calculating a compensating driving frequency corresponding to the compensating frame; and converting a vertical synchronizing signal based on the compensating driving frequency.

7. The method of claim 1, wherein the relatively high frequency is about 60 Hz or faster.

8. The method of claim 1, wherein the relatively low frequency is about 1 Hz or slower.

9. A method of driving a display panel, the method comprising:

generating a first driving period for a plurality of first frames having a first driving frequency;

generating a second driving period for a plurality of second frames having a second driving frequency different than the first driving frequency; and inserting only one compensating frame between the first driving period and the second driving period, wherein the first driving frequency is greater than the second driving frequency, a length of the compensating frame is shorter than a length of one of the second frames, a supplied common voltage is provided to the display panel, a received common voltage is received at a pixel of the display panel, the received common voltage varies between a steady state maximum voltage that is greater than the supplied common voltage and a steady state minimum voltage that is less than the supplied common voltage when the display panel reaches a steady state during inversion driving at the second driving frequency, and during the compensating frame, the received common voltage first reaches the steady state maximum voltage or the steady state minimum voltage at an end of the compensating frame.

10. A method of driving a display panel, the method comprising:

generating a first driving period for a plurality of first frames having a first driving frequency;

generating a second driving period for a plurality of second frames having a second driving frequency different than the first driving frequency; and inserting only one compensating frame between the first driving period and the second driving period, wherein the first driving frequency is less than the second driving frequency, a length of the compensating frame is shorter than a length of one of the first frames, a supplied common voltage is provided to the display panel, a received common voltage is received at a pixel of the display panel, the received common voltage varies between a steady state maximum voltage that is greater than the supplied common voltage and a steady state minimum voltage that is less than the supplied common voltage when the display panel reaches a steady state during inversion driving at the first driving frequency, and during the compensating frame, the received common voltage first reaches the supplied common voltage at an end of the compensating frame.

11. A display apparatus comprising:

a display panel configured to display an image; and a display panel driver configured:

to generate a first driving period for a plurality of first frames having a first driving frequency;

to generate a second driving period for a plurality of second frames having a second driving frequency different than the first driving frequency, one of the first driving frequency and the second driving frequency being a relatively high frequency for displaying a moving image and another of the first driving frequency and the second driving frequency being a relatively low frequency for displaying a still image; and to insert only one compensating frame between the first driving period and the second driving period, the one compensating frame having an intermediate frequency between the relatively high frequency for displaying the moving image and the relatively low frequency for displaying the still image, wherein a length of the one compensating frame corresponds to a time for changing a level of a common voltage of a pixel.

12. The display apparatus of claim 11, wherein the first driving frequency is greater than the second driving frequency.

13. The display apparatus of claim 11, wherein the first driving frequency is less than the second driving frequency.

14. The display apparatus of claim 11, wherein the relatively high frequency is about 60 Hz or faster.

15. The display apparatus of claim 11, wherein the relatively low frequency is about 1 Hz or slower.

* * * * *